United States Patent [19]

Muhlegg

[11] 4,112,664

[45] Sep. 12, 1978

[54] FRICTION FALSE-TWIST DEVICE

[75] Inventor: Kurt Muhlegg, Jona, Switzerland

[73] Assignee: Heberlein Maschinenfabrik AG, Wattwil, Switzerland

[21] Appl. No.: 839,017

[22] Filed: Oct. 3, 1977

[30] Foreign Application Priority Data

Oct. 13, 1976 [CH] Switzerland ..... 12925/76

[51] Int. Cl.[2] ..... D01H 7/92; D02G 1/04

[52] U.S. Cl. ..... 57/77.4; 57/77.45

[58] Field of Search ..... 57/77.4, 77.45, 92, 57/104

[56] References Cited

U.S. PATENT DOCUMENTS

| | | | |
|---|---|---|---|
| 3,385,047 | 5/1968 | Shwibe | 57/77.45 |
| 3,788,056 | 1/1974 | Burri | 57/77.45 |
| 3,878,672 | 4/1975 | Köhler | 57/77.45 |
| 3,919,833 | 11/1975 | Horvath et al. | 57/77.4 |
| 4,002,018 | 1/1977 | Steck | 57/77.45 |

*Primary Examiner*—Donald Watkins

*Attorney, Agent, or Firm*—Larson, Taylor and Hinds

[57] ABSTRACT

Apparatus for friction false-twisting synthetic filaments is described wherein the yarn travels over coaxial hemispherical surfaces inverted with respect to each other and having a gap between them into which projects the edge of a disc. Parallel shafts, respectively carrying an element formed with the surfaces and the disc are carried by a bearing unit beneath which the shafts carry rollers with a driving belt travelling between them. To economize in machine space the bearing unit is mounted to turn about an axis displaced from the axis of one of the shafts towards the belt. The unit can be swivelled from a central position in which the rollers are clear of the belt to positions on each side thereof in which the rollers contact the belt. Means are provided for latching the bearing unit in each of these three positions. In operation, only one of the rollers is fixed to its shaft. Means are provided for locking or freeing each roller to its shaft as required by the nature of the required twist.

6 Claims, 5 Drawing Figures

FRICTION FALSE-TWIST DEVICE

FIELD OF THE INVENTION

The present invention relates to a friction false-twist apparatus with means for individually switching false-twist devices into and out of action when mounted in a texturing machine, as well as for selecting the direction of rotation of the friction elements in such devices.

DESCRIPTION OF THE PRIOR ART

False-twist devices of widely different kinds for continously texturing synthetic filaments are known in which twist tubes with very high revolution speeds are used. In the usual texturing machines with a plurality of processing stations, the driving shafts of the individual false-twist devices are rotated by way of a common driving belt. Each false-twisting device is disposed on a bearing plate through which its rotation shafts pass, driving rollers being fixed on the lower ends of the shafts. The bearing plates can be swivelled round a shaft parallel with the driving shafts whereby application of the driving rollers to the belt or removal thereof from the belt is rendered possible.

Furthermore, also false-twist devices are known in which the twist is imparted to the yarn by direct friction contact with rotating surfaces.

In U.S. Pat. No. 3,919,833, such a friction false twist device is described comprising two friction elements disposed on two axes, one of which has the shape of a sphere or of an ellipsoid or of an ellipsoidal friction element and is provided with at least one annular groove extending transversely with respect to its axis of rotation whereas the secondary friction element comprises at least one circular disc extending transversely with respect to its axis of rotation with the rim of the disc extending into the annular groove.

The industry producing textured yarns nowadays requires texturing machines equipped with friction false-twist devices in which the sense of revolution of individual friction elements can be changed selectively and separately from each other at various locations in the machine. This requirement brings various problems. First of all, an essential requirement is that the lateral spacing between adjoining working stations shall be as small as possible since, in order to obtain high capacity from a texturing machine, one naturally tends to lodge within given machine dimensions, as many working stations as possible. Furthermore, it is also essential that a change of the sense of rotation of the friction elements shall as a consequence produce a deviation of the path of the yarn which is as small as possible because a greater deviation may easily lead to irregularities in yarn quality. Finally, it is also necessary for the individual friction false-twist devices to be switched on and off independently of each other during the operation of the texturing machine.

SUMMARY OF THE INVENTION

It is the purpose of the present invention to provide a friction false-twisting device of the kind described in Swiss patent specification No. 565,263 in which the above-mentioned requirements are fulfilled to a great extent. The device according to the present application is characterized in that two friction elements are mounted on shafts having respectively two rollers which, in operation, are simultaneously applied to a common tangential drive belt and are arranged on a bearing unit which can be swivelled round an axis which is eccentric with respect to the circumference of the roller on one of the shafts, said axis being parallel to said shaft, said bearing unit being arranged to be fixed in any selected one of various angular positions about said axis, and means being provided whereby each roller may be alternatively locked to or made loose on its respective shaft.

Advantageously, the bearing unit, during operation, may be arranged to be fixed in alternative positions, in one of which its central longitudinal axis forms, with a line normal with respect to the direction of movement of the belt, an angle of between 20° and 60°, preferably of 30°, wherein the rollers are in engagement with the belt and in another of which positions the rollers are separated from the belt.

DESCRIPTION OF THE DRAWINGS

In order that the invention may be clearly understood and readily carried into effect, apparatus in accordance therewith will now be described by way of example, with reference to the accompanying drawings, in which.

Figure 1:
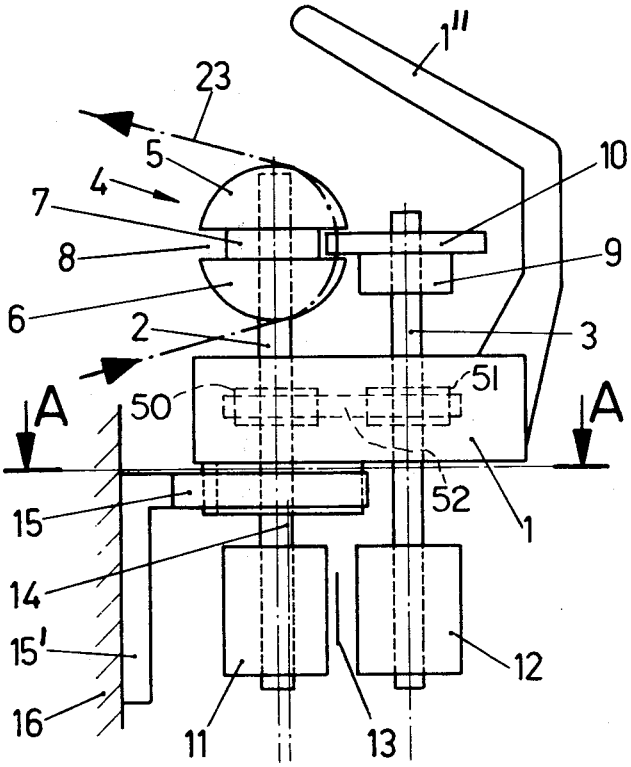
FIG. 1 is a lateral elevation of a friction false-twist device.
Figure 2:
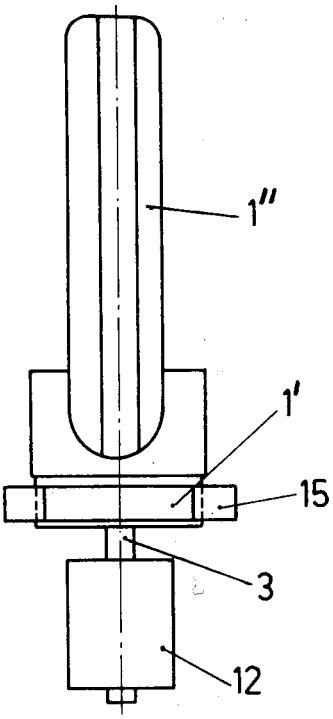
FIG. 2 is a front elevation of the device of FIG. 1.

The device in FIGS. 1 to 4, has a horizontally arranged bearing unit 1 which is provided with two bores through which shafts 2, 3 pass. On the shaft 2, above the bearing unit 1, a main friction element 4 is arranged. This consists of two hemispheres 5, 6 with an intermediate spacer collar 7 which forms an annular groove 8. On the shaft 3, above the bearing unit 1, the secondary friction element is arranged. This consists of a cylindrical body 9 and an annular disc 10, projecting into the annular groove 8. Below the bearing unit 1, rollers 11, 12 are mounted on the shafts 2 and 3. In operation, these are rotated by a driving belt 13. The two shafts are interconnected in the bearing unit 1 by rollers or pulleys 50 and 51 and endless belt 52 so that the shafts rotate together in the same direction. This arrangement is exemplary only, and any other conventional drive arrangement may be used, as is well known in the art.

The bearing unit 1 is provided on its lower face with a circular cylindrical projection 1' the central axis 14 of which is eccentric with respect to the circumference of the roller 11. The circular cylindrical projection 1' fits in an arcuate bearing 15 which is fixed on the machine frame 16 by means of the angle member 15' in a manner not shown in the drawings. The outer surface of the cylindrical projection 1' is provided with three pairs of mutually diametrically opposed grooves 17, 17'; 18, 18' and 19, 19', the connection line of the grooves 18, 18' extending parallel to the direction of movement of the belt 13 when the rollers are idle and the connection lines of the pairs of grooves 17, 17' and 19, 19' each including with the direction of the path of the belt an angle of 60°.

On the inner face of the arcuate bearing 15, two mutually opposed bores 20, 20' are arranged, the connection line of their central axes extending parallel to the path of the belt 13. Helical springs 21, 21' are respectively contained in the bores 20, 20' and these press resiliently cams 22, 22' into one of the pairs of grooves 17, 17'; 18, 18' or 19, 19' so that the bearing body 1 is fixed in the corresponding angular position. By means of a handle 1", the bearing body 1 can be swivelled round the axis 14 so as to be latched by the cams in the desired angular position.

Figure 3:
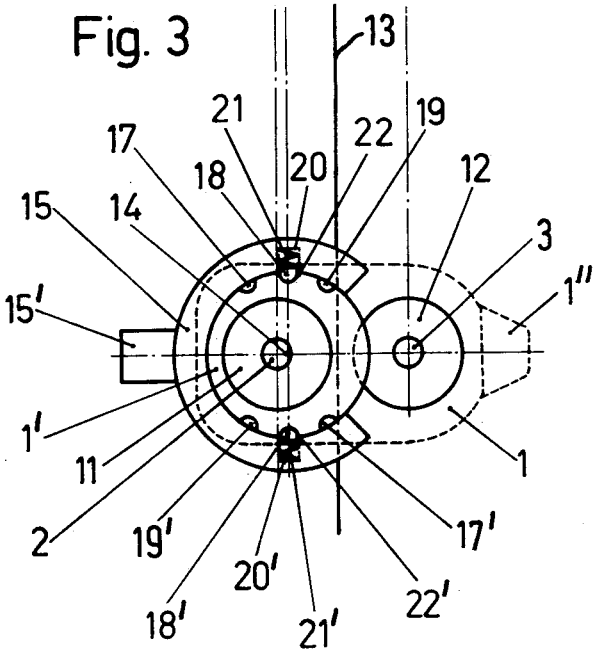
FIG. 3 is a section along line A—A in FIG. 1.

In the angular position shown in FIG. 3, in which the cams 22, 22' engage in the grooves 18. 18', the friction false-twist device is in inactive position because the driving belt 13 is not in contact with the rollers 11, 12.

Figure 5:
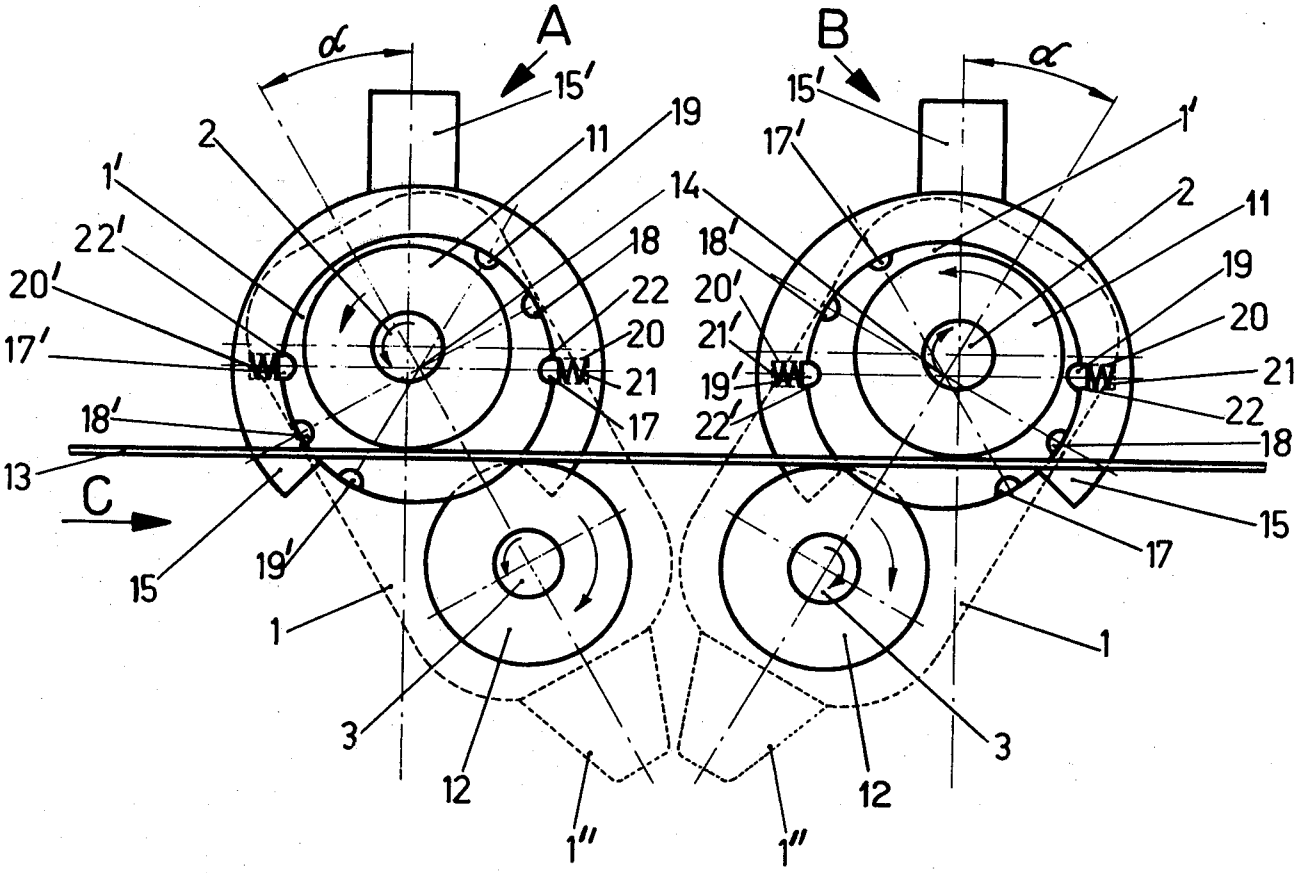
FIG. 5 is a section analogous to FIG. 3 showing two adjoining friction false-twist devices in different angular positions.

The friction false-twist device can be arranged in a plurality of positions on a texturing machine with a corresponding number of yarn treatment posts arranged on both sides of a frame, for example 160, i.e. 80 on each side of the frame. FIG. 5 shows two adjoining friction false-twist devices A and B, both of which are in operative position, each of the central longitudinal axes of the bearing units 1 including with a line normal to the path of the belt movement an angle $\alpha = 30°$, but the two said central longitudinal axes being oppositely inclined with respect to this normal.

Figure 4:
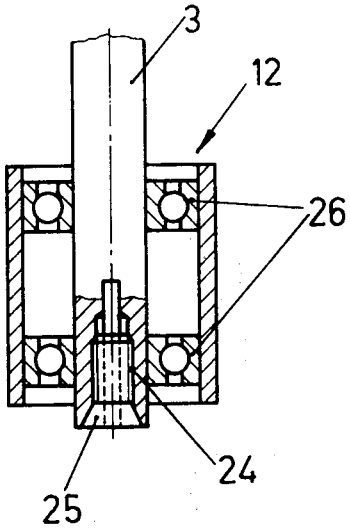
FIG. 4 is a vertical section through a detail of the device of FIG. 1.

In the device A, the roller 11 is locked rigidly to the shaft 2 so as to rotate counterclockwise with the shaft 2 as indicated by the arrows. However, the roller 12 can rotate clockwise loosely on the shaft 3 in device A while shaft 3 rotates counterclockwise. In the device B, however, the arrangement is reversed, i.e. the roller 11 is loose on the shaft 2 and thus rotates counterclockwise oppositely from the clockwise rotation of its shaft 2 while the roller 12 is locked to the shaft 3 for clockwise rotation therewith. For locking the rollers 11, 12 tightening means are provided, as shown in FIG. 4. The lower end of each shaft 2 and 3, has, in a tightening zone, a thin walled hollow cavity which is provided with at least one longitudinal slot enabling the end of the shaft to be expanded so as frictionally to lock a bearing 26 interposed between the shaft 3 and roller 12. The cavity has an internal screw thread 24 into which may be screwed a screw with a conical head 25 arranged to expand the end of the shaft 3 as the screw is screwed into the cavity. The bearing 26 is a rolling bearing, the lower, inner race of which can expand slightly to permit the aforesaid locking. Thus, the shafts 2, 3 of the device A are driven in counterclockwise directions and the shafts 2, 3 of device B in clockwise directions. The device A accordingly imparts to the yarn 23 (FIG. 1) a false-twist in S direction, and the device B imparts to the yarn 23 a Z false-twist.

As furthermore shown in FIG. 5, the devices leave relatively small spaces between the individual yarn treatment posts, particularly because, due to eccentric adjustment of the rotation axes 14, both bearing units 1, upon swivelling, move less laterally than would be the case in swivelling around the shaft 2. Furthermore, the handles 1" of the bearing units 1 are shaped so that they screen the two friction elements 4, 9 and 10 and in the position shown in FIG. 5, the devices A and B lie near each other. The handles, therefore, result in effective protection against damage or injury when the devices are being manipulated. The handles also protect the mechanism against impact by falling objects.

Furthermore, the device has the advantage that, because of the eccentric arrangement of the rotation axis 14, when the bearing unit 1 is swivelled to the right or to the left from the central, idle position, the path of the yarn 23 from the surface of the hemisphere 5 undergoes a relatively small deviation from the central position so that deviation of the yarn in the texturing zone is minimal and irregularities in yarn quality can be avoided to a great extent.

Finally, the eccentric arrangement of the swivelling axis 14 results, when the bearing unit 1 is turned into the quiet or idle position, in certain separation of the rollers 11, 12 from the driving belt 13 so that independent switching-in and switching-off of the individual friction false-twist devices during operation of the texturing machine is ensured.

I claim:

1. Friction false-twist apparatus comprising a bearing unit formed therein with two journal bearing means respectively for two parallel rotary shafts, a first rotary shaft mounted in one said bearing means, a first friction element fixed to said first shaft, said first friction element comprising a first portion presenting a first convex surface of revolution about the axis of said first shaft, with said axis intersecting the convex end portion of said convex surface, and a second portion presenting a second convex surface of revolution about said axis of said first shaft and inverted relatively to said first portion to present a convex end portion of its convex surface facing oppositely to said first-mentioned convex end portion, a second rotary shaft mounted in the other said bearing means, a second friction element in the form of a circular disc-like friction member fixed co-axially with the axis of said second shaft, said first and second portions being displaced axially from one another with respect to said axis of said first shaft and said disc-like member being formed and positioned so that its rim projects between said first and second portions, first and second driving rollers mounted coaxially respectively on said shafts, releaseable means for locking each said roller to its respective shaft whereby each said roller may be locked to or rendered loose on its shaft, a common tangential driving belt arranged to travel in a straight line between said rollers, a support for said bearing unit, pivotal bearing means interposed between said bearing unit and said support whereby said bearing unit can be swivelled about a fixed axis displaced from and parallel to said first-mentioned axis towards an adjacent surface of said driving belt, and means for fixing said bearing unit in at least two positions about said fixed axis, the first of said positions being such that said rollers are free from said driving belt and the second of said positions being such that said rollers respectively engage opposite faces of said belt.

2. Apparatus according to claim 1, in which the angular separation between said two positions is such that a line normal to said belt makes an angle of between 20° and 60° (inclusive) with respect to a plane containing the axes of said first and second shafts.

3. Apparatus according to claim 2, in which said angle is approximately 30°.

4. Apparatus according to claim 1, comprising a handle fixed to said bearing unit and shaped to extend over said friction elements so as at least partially to screen said friction elements.

5. Apparatus according to claim 1, in which said rollers are rotatably mounted about ends of said shafts, said ends of said shafts each being formed with a slotted, thin-walled screw-threaded cavity, two screws having tapered portions being mounted respectively in said cavities for expanding said ends of said shafts by screwing them inwards in said cavities, thereby providing said releaseable locking means.

6. Apparatus according to claim 1, in which a rolling bearing is interposed between each said roller and its respective shaft.

* * * * *